US008590200B2

(12) United States Patent
Domian

(10) Patent No.: US 8,590,200 B2
(45) Date of Patent: Nov. 26, 2013

(54) FIREARM WITH MAGAZINE DISCONNECTOR

(75) Inventor: Robert Ernest Domian, Columbia, SC (US)

(73) Assignee: Sig Sauer, Inc., Newington, NH (US)

( * ) Notice: Subject to any disclaimer, the term of this patent is extended or adjusted under 35 U.S.C. 154(b) by 178 days.

(21) Appl. No.: 13/304,587

(22) Filed: Nov. 25, 2011

(65) Prior Publication Data

US 2013/0133237 A1 May 30, 2013

(51) Int. Cl.
*F41A 17/36* (2006.01)

(52) U.S. Cl.
USPC ..... 42/70.02; 42/70.01

(58) Field of Classification Search
USPC ..... 42/70.02, 70.01, 70.06, 70.08
See application file for complete search history.

(56) References Cited

U.S. PATENT DOCUMENTS 3,857,322 A * 12/1974 Lichtman ..... 89/145
4,589,327 A * 5/1986 Smith ..... 89/148
5,736,667 A * 4/1998 Munostes et al. ..... 89/132
6,519,887 B1 * 2/2003 Allen et al. ..... 42/70.02
7,581,345 B2 * 9/2009 McGarry ..... 42/70.02
8,438,768 B2 * 5/2013 Kallio ..... 42/70.02
2012/0174453 A1 * 7/2012 Kallio ..... 42/70.02
2012/0285063 A1 * 11/2012 Woodford ..... 42/70.11
2012/0291325 A1 * 11/2012 Carr ..... 42/70.02

* cited by examiner

*Primary Examiner* — Michael David
(74) *Attorney, Agent, or Firm* — Finch & Maloney PLLC

(57) ABSTRACT

Firearms with magazine disconnectors include a trigger bar having a first end connected to the trigger and a second end proximate the hammer, the trigger bar being movable between a connected position where the second end operably engages the hammer to operate the hammer responsive to trigger actuation, and a disconnected position where the second end is disengaged from the hammer, such that trigger actuation does not operate the hammer. The disconnector is movable between a first position where the disconnector extends into the magazine well and moves the trigger bar to the disconnected position, and a second position where the disconnector is outside of the magazine well and moves the trigger bar to the connected position. The disconnector is biased to the first position in the absence of a magazine in the magazine well, and operable responsive to insertion of a magazine to move to the first position.

8 Claims, 8 Drawing Sheets

FIREARM WITH MAGAZINE DISCONNECTOR

FIELD OF THE INVENTION

The present invention relates to a firearm with magazine disconnector that disables firing operation if a magazine is not fully installed in the magazine well.

BACKGROUND OF THE INVENTION

Some jurisdictions have mandated that certain firearms like auto-loading pistols have a feature that prevents them from firing with the magazine removed. This is intended to address the possibility of negligent discharges occurring due to misuse by someone who removes the magazine, assumes the gun is unloaded, and then violates firearm safety rules by pointing it at someone and pulling the trigger.

Various magazine safety mechanisms have been employed to meet this legal requirement. However, they all place the firearm's trigger bar and/or trigger under stress if a user attempts to fire the handgun with the magazine removed. For instance, an element that blocks the trigger movement when a magazine is removed is vulnerable to failure under excessive trigger pressure. Furthermore, the firearm functions properly if the magazine safety feature is removed. This enables users to make unsafe modifications to their weapons without compromising their operation.

Therefore, a need exists for a new and improved firearm with a magazine disconnector that disconnects the firearm's trigger from the hammer if the magazine is not fully installed in the magazine well. In this regard, the various embodiments of the present invention substantially fulfill at least some of these needs. In this respect, the firearm with magazine disconnector according to the present invention substantially departs from the conventional concepts and designs of the prior art, and in doing so provides an apparatus primarily developed for the purpose of disconnecting the firearm's trigger bar from the hammer if the magazine is not fully installed in the magazine well, thereby preventing discharge even if the trigger is pulled while a round resides in the firearm's chamber.

SUMMARY OF THE INVENTION

The present invention provides an improved firearm with magazine disconnector, and overcomes the above-mentioned disadvantages and drawbacks of the prior art. As such, the general purpose of the present invention, which will be described subsequently in greater detail, is to provide an improved firearm with magazine disconnector that has all the advantages of the prior art mentioned above.

To attain this, the preferred embodiment of the present invention essentially comprises a frame defining a magazine well, a trigger, hammer, and disconnector connected to the frame, an elongated trigger bar having a first end connected to the trigger and a second end proximate the hammer, the trigger bar being movable between a connected position in which the second end operably engages the hammer to operate the hammer in response to actuation of the trigger, and a disconnected position in which the second end is disengaged from the hammer, such that actuation of the trigger does not operate the hammer, the disconnector having an extending portion, the disconnector being movable between a first position in which the extending portion extends into the magazine well, and a second position in which the extending portion is outside of the magazine well, the disconnector being biased to the first position in the absence of a magazine in the magazine well, and operable in response to insertion of a magazine to move to the first position, and the disconnector and trigger bar being operably connected to move the trigger bar to the disconnected position when the disconnector is in the first position, and to move the trigger bar to the connected position when the disconnector is in the second position. The first end of the trigger bar may be pivotally connected to the trigger. The hammer may have a hook, and the trigger bar may have a hook-engagement element that engages the hook when the trigger bar is in the connected position, such that pulling the trigger a first amount cocks the hammer and further pulling of the trigger releases the hammer to discharge the firearm. The disconnector may include a release surface portion that operably contacts an intermediate portion of the trigger bar when the trigger bar is in the connected position, the operable contact causing the hook engagement element to disengage from the hook in response to the further pulling of the trigger. Removal of the disconnector may disable the operation of the firearm. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
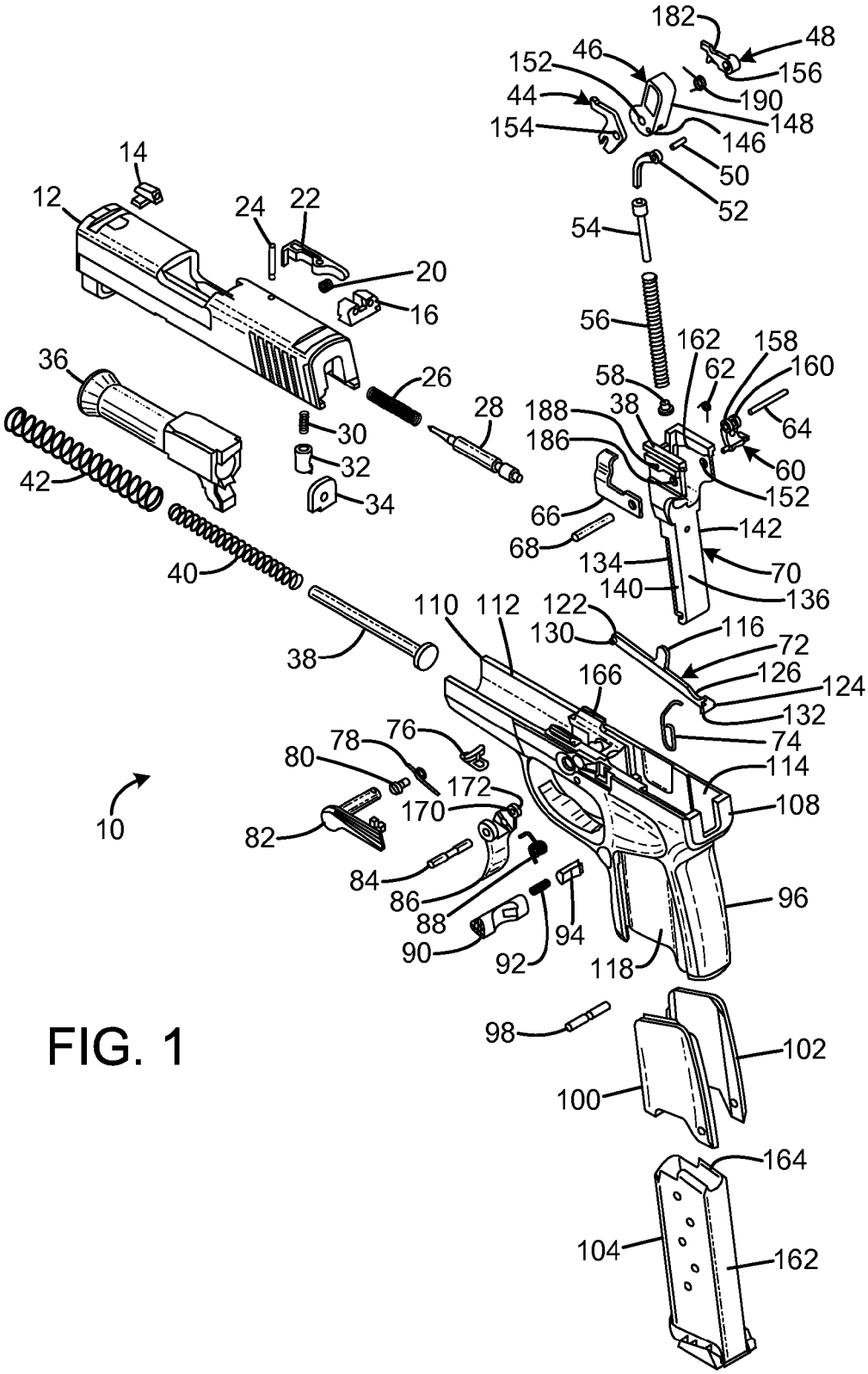
FIG. 1 is a top perspective exploded view of the current embodiment of the firearm with magazine disconnector constructed in accordance with the principles of the present invention.

A preferred embodiment of the firearm with magazine disconnector of the present invention is shown and generally designated by the reference numeral 10.

FIG. 1 illustrates the improved firearm with magazine disconnector 10 of the present invention. More particularly, the firearm 10 is a semi-automatic pistol that has a molded frame 96 that receives multiple components when the firearm is assembled. The top 112 of the frame receives a slide 12 with associated components. The rear 108 interior 114 of the frame receives a rear housing 70 with associated components. A locking block 106 is molded into the top interior of the frame forward of the rear housing. The rear 108 of the frame forms a magazine well 118 that receives a magazine 104. A laser plug 76, slide stop and takedown lever spring 78, takedown spring screw 80, slide stop and takedown lever 82, trigger pivot pin 84, trigger 86, trigger spring 88, magazine catch 90, magazine catch spring 92, magazine catch stop 94, left grip 100, and right grip 102 are also attached to the frame.

The following components are associated with the slide 12: a front sight 14, a rear sight 16, an extractor spring 20, an extractor 22, an extractor pin 24, a firing pin spring 26, a firing pin 28, a firing pin block spring 30, a firing pin block 32, a firing pin stop 34, a barrel 36, a recoil spring guide 38, an inner recoil spring 40, and an outer recoil spring 42. Because the assembly and operation of these components is well-known to one of ordinary skill in the art, no further description will be provided.

The following components are associated with the rear housing 70: a firing pin disconnector 44, a hammer 46, a magazine disconnector 48, a hammer strut pivot pin 50, a hammer strut 52, a mainspring seat 54, a hammer spring 56, a mainspring housing pin lock 58, a firing pin safety link 60, a link spring 62, a link pivot pin 64, and ejector 66, a hammer pivot pin 68, a trigger bar 72, a trigger bar spring 74, and a rear housing pin 98. Further description of the rear housing and the associated components thereof will be provided subsequently.

Figure 2A:
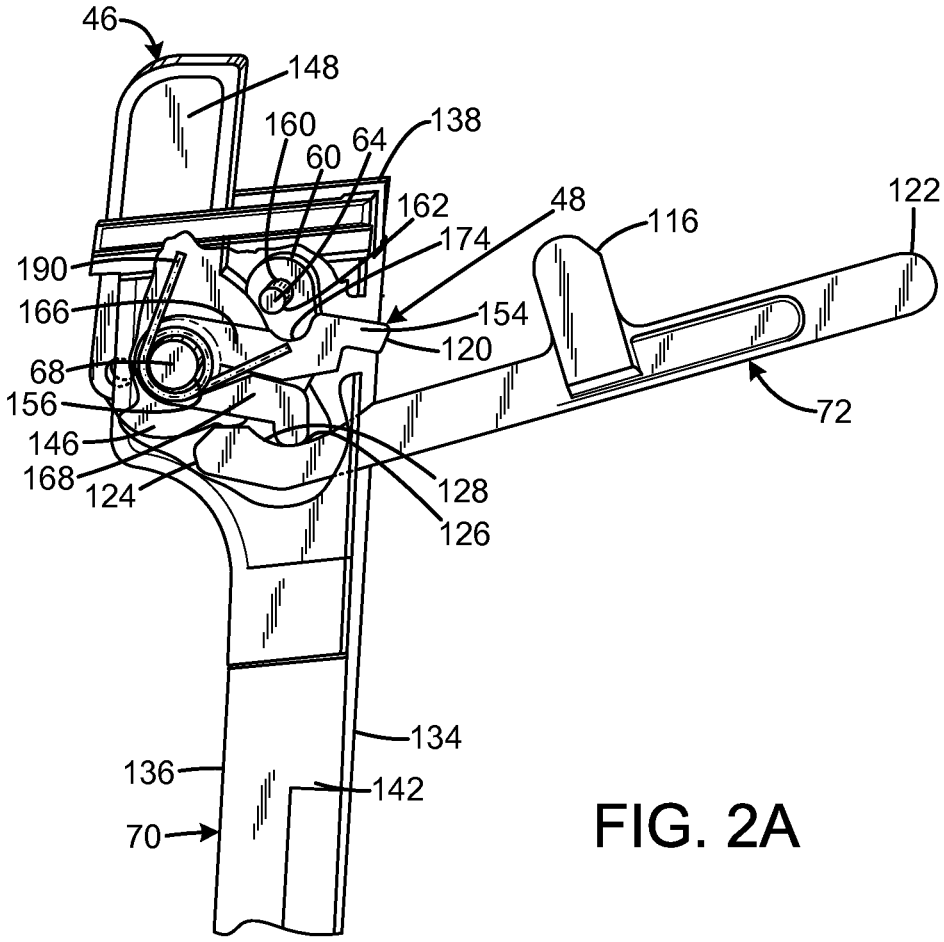
FIG. 2A is a right side perspective partial view of the current embodiment of the rear housing with associated components installed.
Figure 2B:
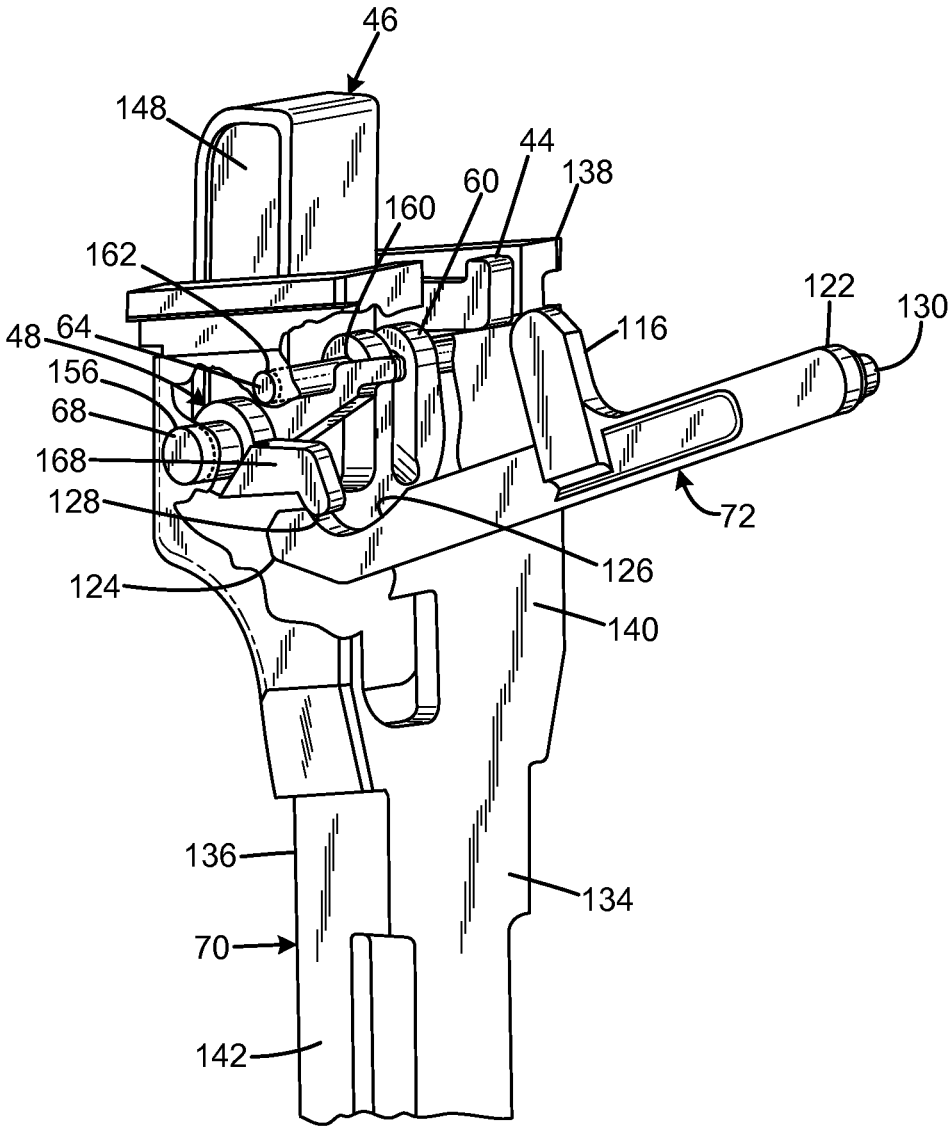
FIG. 2B is a front perspective partial view of the current embodiment of the rear housing with associated components installed.
Figure 2C:
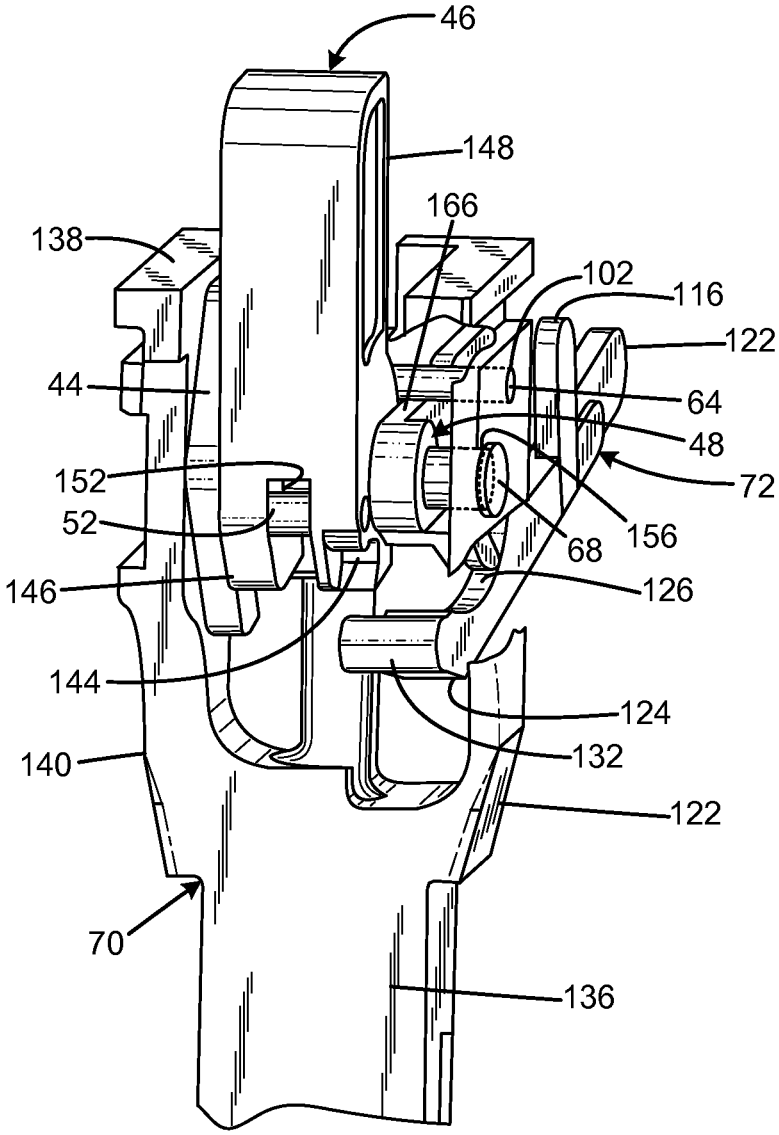
FIG. 2C is a rear perspective partial view of the current embodiment of the rear housing with associated components installed.

FIGS. 2A-2C illustrate an upper portion of the rear housing 70 and the associated components thereof in an assembled state without the extractor 66 and with the magazine 104 removed. More particularly, the rear housing has a front 134, rear 136, top 138, left side 140, and right side 142. The top of the rear housing forms a generally U-shaped channel that permits the associated components to protrude from the top, front, and rear. From left to right, the U-shaped channel receives the firing pin disconnector 44, hammer 46, hammer strut 52, link 60, and link spring 62, and the magazine disconnector 48. The hammer pivot pin 68 passes through aperture 186 in the left side of the rear housing, the aperture 154 in the firing pin disconnector, the aperture 152 in the hammer, the aperture 150 in the magazine disconnector, and the aperture 152 in the right side of the rear housing to pivotally mount all of the aforementioned components within the U-shaped channel.

A link pivot pin 64 passes through the aperture 188 in the left side of the rear housing, the apertures 158 and 160 in the link 60, a notch 182 in the left arm 166 of the magazine disconnector, and the aperture 162 in the right side of the rear housing to pivotally mount the sear within the U-shaped channel.

The trigger bar 72 is positioned so that its rear 124 is received within the U-shaped channel in the rear housing 70 and its front 122 protrudes from the front 134 of the rear housing. The top of the trigger bar forms a boss 116 in its middle and has a cam track 126 formed at the top rear. The front of the trigger bar forms a front cylindrical portion 130 that extends to the left. The rear of the trigger bar forms a rear cylindrical portion 132 that also extends to the left.

The hammer 46 is positioned so that the hammer extends upwards from the top 138 of the rear housing 70 and rearwards from the rear 136 of the rear housing. The bottom 146 right side 148 of the hammer forms a cocking surface 144.

The left arm 166 and right arm 168 of the magazine disconnector 48 are positioned at an acute angle and extend forward from the aperture 150. The front end of the left arm terminates in a magazine contact surface 120. The magazine contact surface is rounded to limit any wedging effect on the magazine 104 that would impede insertion of the magazine. The front end of the right arm terminates in a cam portion 128. The cam portion 128 rides in the cam track 126 on the top rear portion of the trigger bar 72. As is depicted in FIGS. 2A-2C, the magazine disconnector spring 190 biases the magazine disconnector in a downwards, clockwise direction. The implications of this will be discussed subsequently.

As can be shown especially clearly in FIG. 2C, if the magazine disconnector 48 is removed, the remaining components installed in the rear housing 70 will shift, causing interferences, binding, and improper function of the firearm 10. In particular, the proper position of the hammer 46 will not be maintained. Therefore, an attempt to defeat the safety features of the magazine disconnector by removing the magazine disconnector from the rear housing will not be successful because the performance of the firearm is severely compromised.

Figure 3:
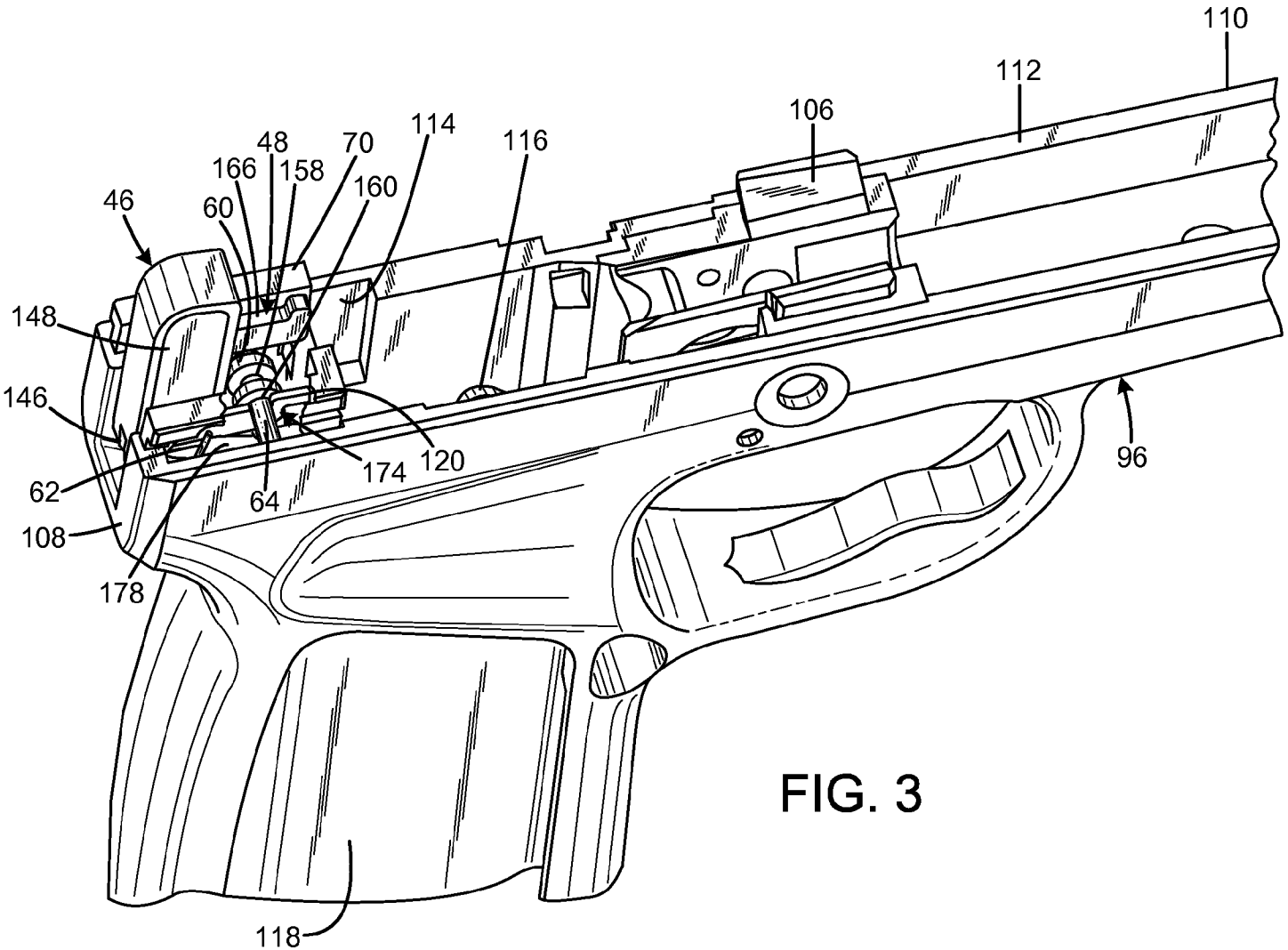
FIG. 3 is a top perspective view of the current embodiment of the frame with the rear housing with associated components installed therein.

FIG. 3 illustrates the frame 96 with the rear housing 70 with associated components in an assembled state and installed therein and with the trigger 86 and associated components removed. More particularly, the assembled rear housing 70 is inserted into the rear 108 interior 114 of the frame through the top 112 behind the locking block 106. The rear housing is secured within the interior of the frame by the rear housing pin 98 (visible in FIG. 1).

Figure 4:
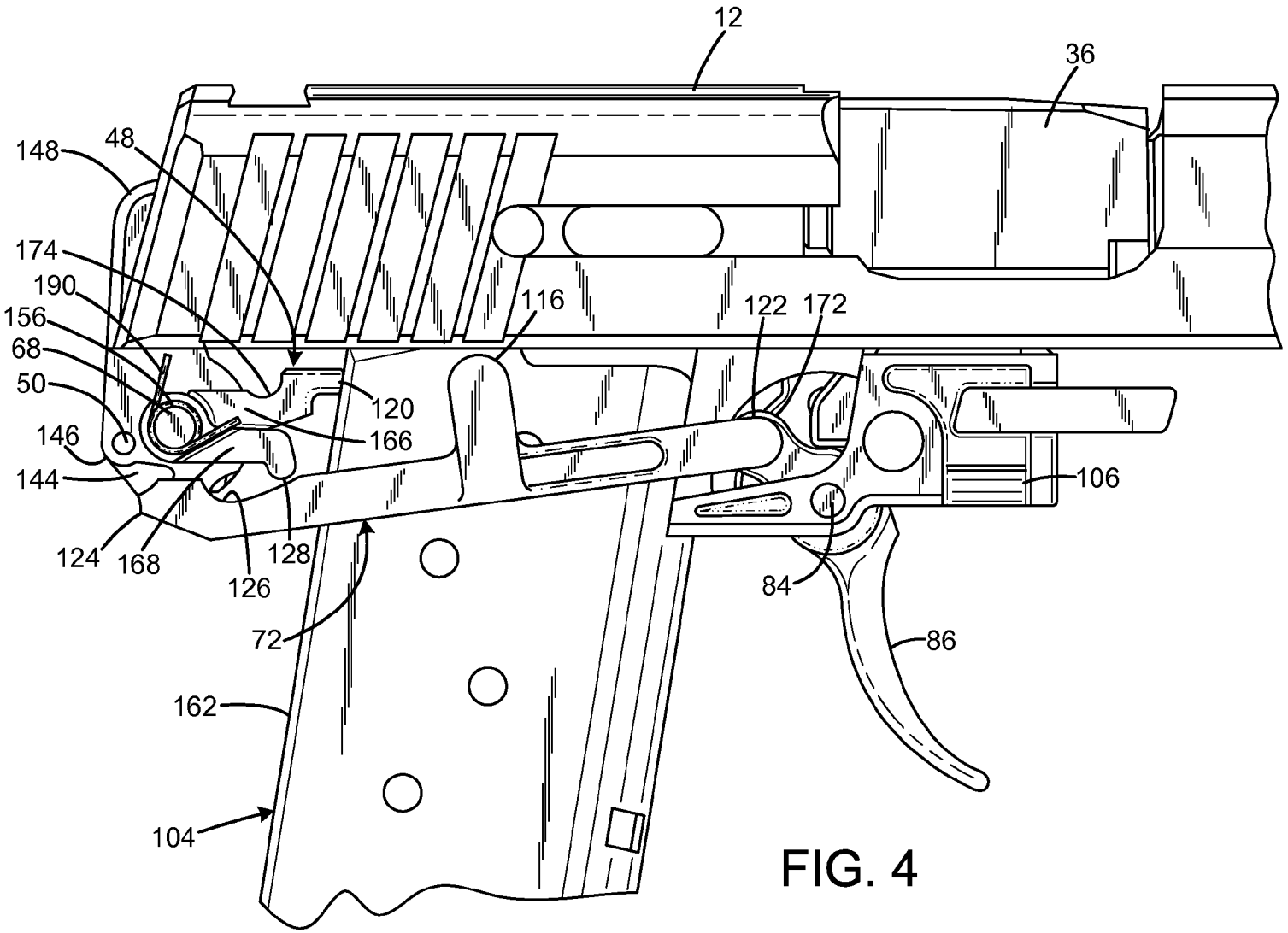
FIG. 4 is a right side view of the current embodiment of the firearm with magazine disconnector with the magazine installed and the frame removed.

FIG. 4 illustrates the firearm 10 in an assembled state with the magazine 104 installed and the frame 96 and rear housing 70 removed. More particularly, the trigger 86 is pivotally attached to the locking block 106 by the trigger pivot pin 84. The trigger is free to pivot while being pulled. The front 122 of the trigger bar 72 is connected to the trigger. This is accomplished by insertion of the front cylindrical portion 130 into an aperture 170 in the top right side of the trigger.

When the magazine 104 is inserted into the magazine well 118 of the frame 96, a top 164 rear 162 portion of the magazine contacts the magazine contact surface 120 of the left arm 166 of the magazine disconnector 48. The upward movement of the magazine during insertion overcomes the clockwise spring biased exerted by the magazine disconnector spring 190. This forces the magazine disconnector upwards and rotates the magazine disconnector in a counterclockwise direction. This movement of the magazine disconnector causes the rear cylindrical portion 132 located at the rear 124 of the trigger bar to contact the cocking surface 144 of the hammer 148.

In this position, rotating (point) the trigger 86 to the rear causes the trigger bar 72 to rotate (cock) the hammer 148 and compress the hammer spring 56. Continued rearward pulling motion of the trigger causes the cam portion 128 of the magazine disconnector 48, which rides in the cam track 126 of the trigger bar, to infringe on the trigger bar. This causes the rear cylindrical portion 132 of the trigger bar to disengage the cocking surface 144 of the hammer. The hammer spring then urges the hammer forward against the firing pin 28 to fire a cartridge. The magazine disconnector subsequently prevents the rear cylindrical portion 132 of the trigger bar from reengaging the cocking surface of the hammer until the trigger is returned to its forward position by the trigger spring 88.

Figure 5:
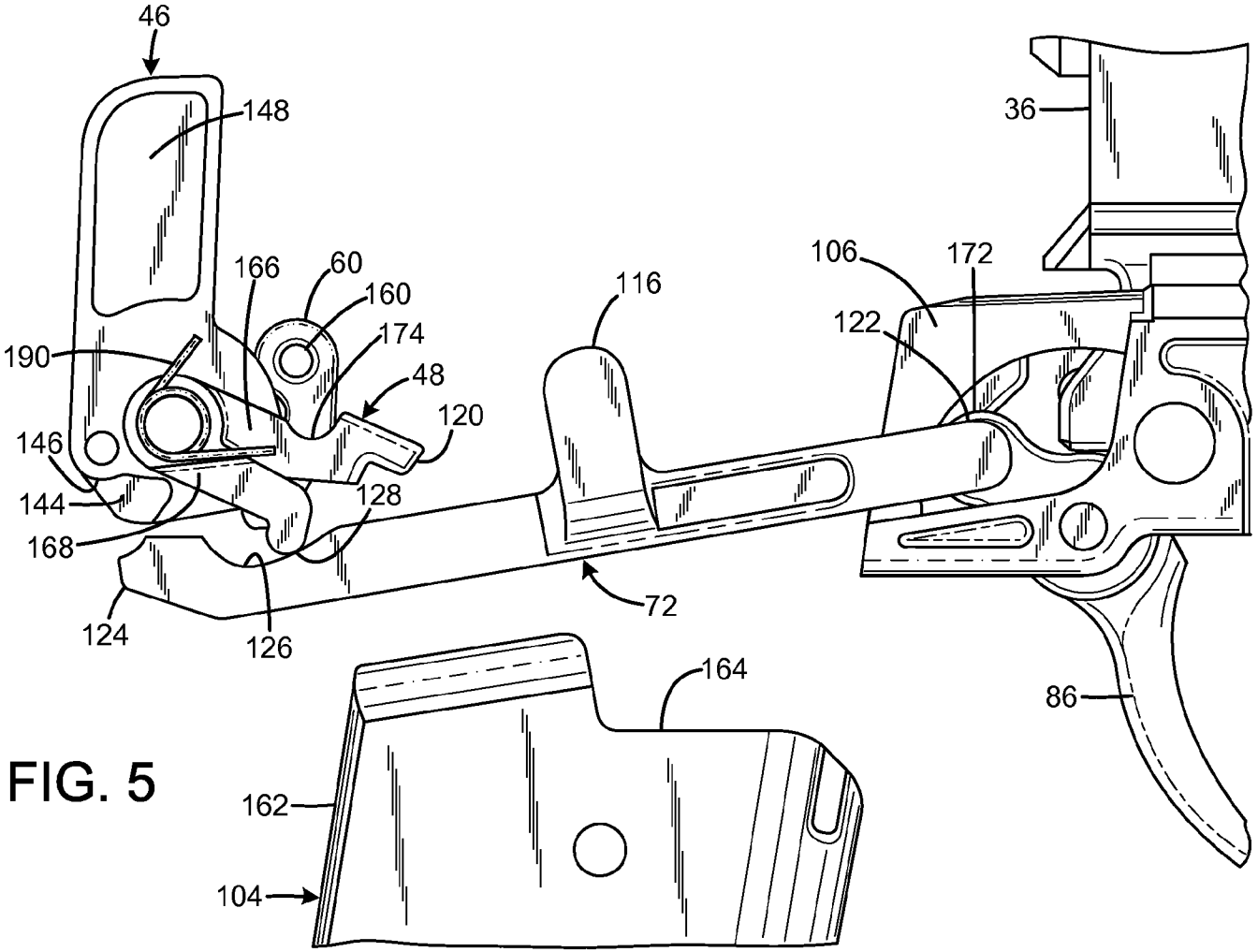
FIG. 5 is a right side view of the current embodiment of the firearm with magazine disconnector with the magazine partially removed and the frame removed.

FIG. 5 illustrates the firearm 10 of FIG. 4 with the magazine 104 partially removed. The magazine no longer contacts the magazine contact surface 120 of the magazine disconnector 48. As a result, the magazine disconnector spring 190 rotates the magazine disconnector clockwise so the left arm 166 intrudes into the magazine well 118. In this position, the cam portion 128 of the right arm 168 of the magazine disconnector infringes on the trigger bar 72, thereby disengaging the rear cylindrical portion 132 of the trigger bar 72 from the cocking surface 144 of the hammer 148. The firearm 10 is thus rendered inoperable until the magazine is again placed in position within the magazine well because pulling the trigger does not have any effect on the hammer. Moreover, no components of the firearm experience unusual stress because no components resist trigger movement to disable the firearm.

Figure 6:
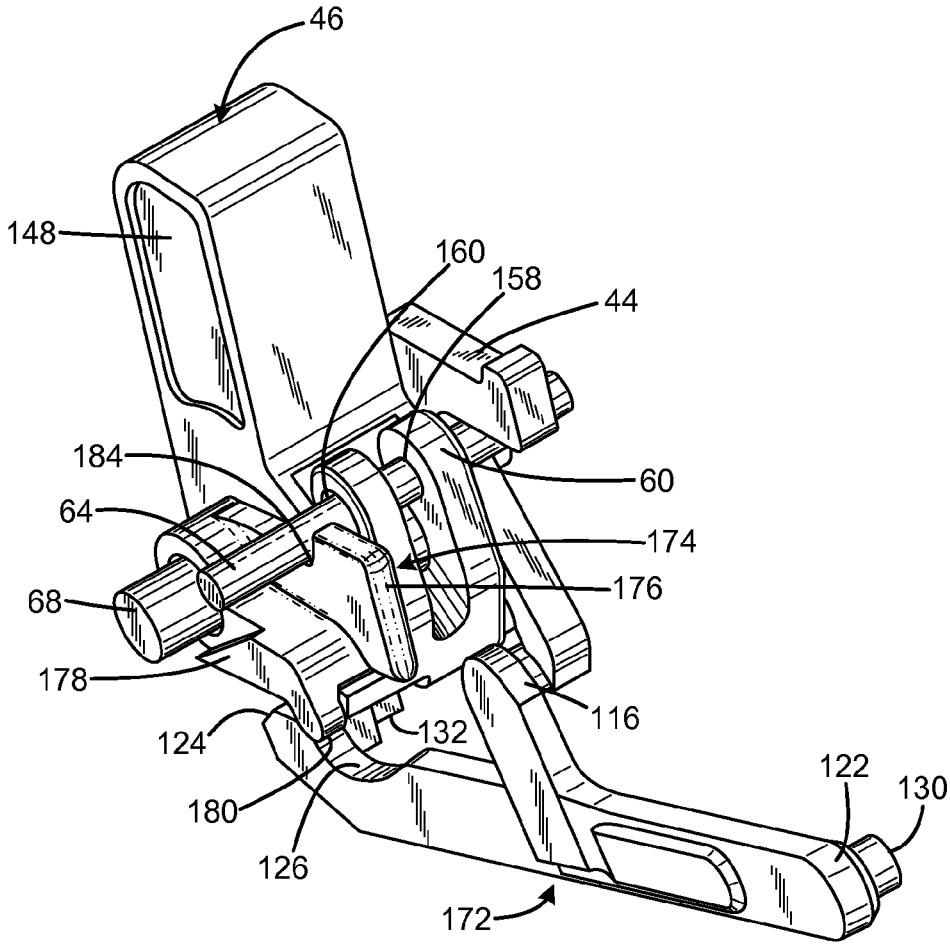
FIG. 6 is a top perspective view of an alternative embodiment of the trigger bar disconnector and associated components.

FIG. 6 illustrates an alternative embodiment of a trigger bar disconnector 174, which omits the magazine disconnection features of the firearm 10 of the present invention. More particularly, the left arm 176 is substantially shorter than the left arm 166 of the magazine disconnector 48 and does not intrude into the magazine well 118 when the magazine 104 is not in the fully inserted position. The notch 184, right arm 178, and cam portion 180 are otherwise identical to the corresponding features of the magazine disconnector 48. As a result, the removal of the magazine has no effect on the function of a firearm incorporating the trigger bar disconnector 174.

While a current embodiment of the firearm with magazine disconnector has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although a pistol incorporating the magazine disconnector of the present invention has been described, it should be appreciated that the magazine disconnector herein described is suitable for use in any appropriate type of firearm. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a frame defining a magazine well;

a trigger connected to the frame;

a hammer connected to the frame;

a disconnector connected to the frame;

an elongated trigger bar having a first end connected to the trigger and a second end proximate the hammer;

the trigger bar movable between a connected position in which the second end operably engages the hammer to operate the hammer in response to actuation of the trigger, and a disconnected position in which the second end is disengaged from the hammer, such that actuation of the trigger does not operate the hammer;

the disconnector having an extending portion;

the disconnector being movable between a first position in which the extending portion extends into the magazine well, and a second position in which the extending portion is outside of the magazine well;

the disconnector being biased to the first position in the absence of a magazine in the magazine well, and operable in response to insertion of a magazine to move to the first position; and the disconnector and trigger bar being operably connected to move the trigger bar to the disconnected position when the disconnector is in the first position, and to move the trigger bar to the connected position when the disconnector is in the second position.

2. The firearm of claim 1 wherein the first end of the trigger bar is pivotally connected to the trigger.

3. The firearm of claim 1 wherein the hammer has a hook, and the trigger bar has a hook-engagement element that engages the hook when the trigger bar is in the connected position, such that pulling the trigger a first amount cocks the hammer and further pulling of the trigger releases the hammer to discharge the firearm.

4. The firearm of claim 3 wherein the disconnector includes a release surface portion that operably contacts an intermediate portion of the trigger bar when the trigger bar is in the connected position, the operable contact causing the hook engagement element to disengage from the hook in response to the further pulling of the trigger.

5. The firearm of claim 1 wherein removal of the disconnector disables the operation of the firearm.

6. The firearm of claim 1 wherein the trigger has a range of motion between a released position and a firing position, both when the disconnector is in the first position and when the disconnector is in the second position.

7. A firearm comprising:

a frame defining a magazine well;

a firing mechanism connected to the frame;

a trigger connected to the frame operably connected to the firing mechanism;

the trigger including a magazine safety element movable between a first position protruding into the magazine well in the absence of a magazine, and a second position in response to the presence of a magazine in the magazine well; and the operable connection between the trigger enabling operation of the firing mechanism when the magazine safety element is in the second position, and disabling operation of the firing mechanism when the magazine safety element is in the first position, such that the firearm may not be discharged without a magazine.

8. The firearm of claim 7 wherein the trigger is movable between a released position and a firing position, both when the magazine safety element is in the first position and when the magazine safety element is in the second position.

* * * * *